US005528832A

United States Patent [19]

Schmidt

[11] Patent Number: 5,528,832

[45] **Date of Patent: *Jun. 25, 1996**

[54] SCRAPER

[75] Inventor: Sheldon Schmidt, Paramus, N.J.

[73] Assignee: Great Neck Manufacturers, Inc., Mineola, N.Y.

[ * ] Notice: The term of this patent shall not extend beyond the expiration date of Pat. No. 5,319,853.

[21] Appl. No.: 441,268

[22] Filed: May 15, 1995

Related U.S. Application Data

[60] Continuation of Ser. No. 161,534, Dec. 6, 1993, abandoned, which is a division of Ser. No. 970,394, Nov. 2, 1992, Pat. No. 5,319,853.

[51] Int. Cl.[6] ..... A47L 13/08; B26B 29/02

[52] U.S. Cl. ..... 30/169; 30/151; 30/337

[58] Field of Search ..... 30/136, 151, 167, 30/168, 169, 272.1, 389, 79, 286, 337, 339; 7/124, 167

[56] References Cited

U.S. PATENT DOCUMENTS

| | | | |
|---|---|---|---|
| 1,241,969 | 10/1917 | Hartman | 30/286 |
| 1,768,604 | 7/1930 | Hurd | 30/151 |
| 2,122,263 | 6/1938 | Pinter | 30/286 X |
| 2,321,706 | 6/1943 | Salsbury | 30/151 |
| 2,580,142 | 12/1951 | Voight | 30/286 |
| 2,800,672 | 6/1957 | Gilyan | 7/167 X |
| 3,078,572 | 2/1963 | Everton | 30/169 |
| 3,667,122 | 6/1972 | Black | 30/286 |
| 4,675,996 | 6/1987 | DuBuque | 30/151 X |
| 4,955,138 | 9/1990 | Henke et al. | 30/169 |
| 5,056,226 | 10/1991 | Gringer | 30/169 |
| 5,139,507 | 8/1992 | Dolgin et al. | 30/151 X |
| 5,299,357 | 4/1994 | Wonderley et al. | 30/329 X |
| 5,319,853 | 6/1994 | Schmidt | 30/169 |
| 5,433,004 | 7/1995 | Thompson et al. | 30/169 |

FOREIGN PATENT DOCUMENTS

| | | | |
|---|---|---|---|
| 852659 | 10/1960 | United Kingdom | 30/286 |

*Primary Examiner*—Rinaldi I. Rada
*Assistant Examiner*—Clark F. Dexter
*Attorney, Agent, or Firm*—Joseph J. Previto

[57] ABSTRACT

A scraper having a body portion with a front edge and a cover portion slidable relative to the body portion. The blade is received in the body portion with its cutting edge extending beyond the front edge of the body portion. The cover portion is movable relative to the body portion from a retracted position exposing the blade cutting edge to an extended position overlying the blade cutting edge. The cover portion is held in its retracted and/or its extended positions by locking mechanisms on the cover portion and on the body portion which cooperate with each other to hold the cover in its retracted and/or extended positions.

9 Claims, 2 Drawing Sheets

SCRAPER

This patent application is a continuation of patent application Ser. No. 08/161,534 filed Dec. 6, 1993, now abandoned, which was a division of Ser. No. 07/970,394 filed Nov. 2, 1992, now U.S. Pat. No. 5,319,858.

BACKGROUND

The present invention relates to a scraper and more particularly to a scraper for use with a single edge razor blade.

Various types of scrapers have been designed over the years. In using a scraper that utilizes a razor blade, it is important that the bare blade be covered when the scraper is not in use in order to prevent the bare blade from injuring someone. In this connection, some prior scrapers place a blade in a retractable holder so that when the blade is not in use, the holder with the blade is retracted within a casing so as to hide the blade. Other scrapers use protective covers which are pivotally moved to a position to hide the exposed blade edge. Still other scrapers have covers which are moved over the blade and are locked in place by tightening of a set screw or some other device. Examples of these scrapers are shown and described in U.S. Pat. Nos. 2,336,284 and 3,667,122. Other types of scraping devices are shown in U.S. Pat. Nos. 4,189,829, 4,612,707 and 4,706,385.

OBJECTS

The present invention provides an improved scraper which has improved means for exposing or covering the blade of a single edge safety razor blade.

Another object of the present invention is the provision of an improved scraper which may be inexpensively manufactured.

Another object of the present invention is the provision of an improved scraper in which the blade may be easily removed and replaced.

Another object of the present invention is the provision of an improved scraper which is lightweight and easy to handle.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
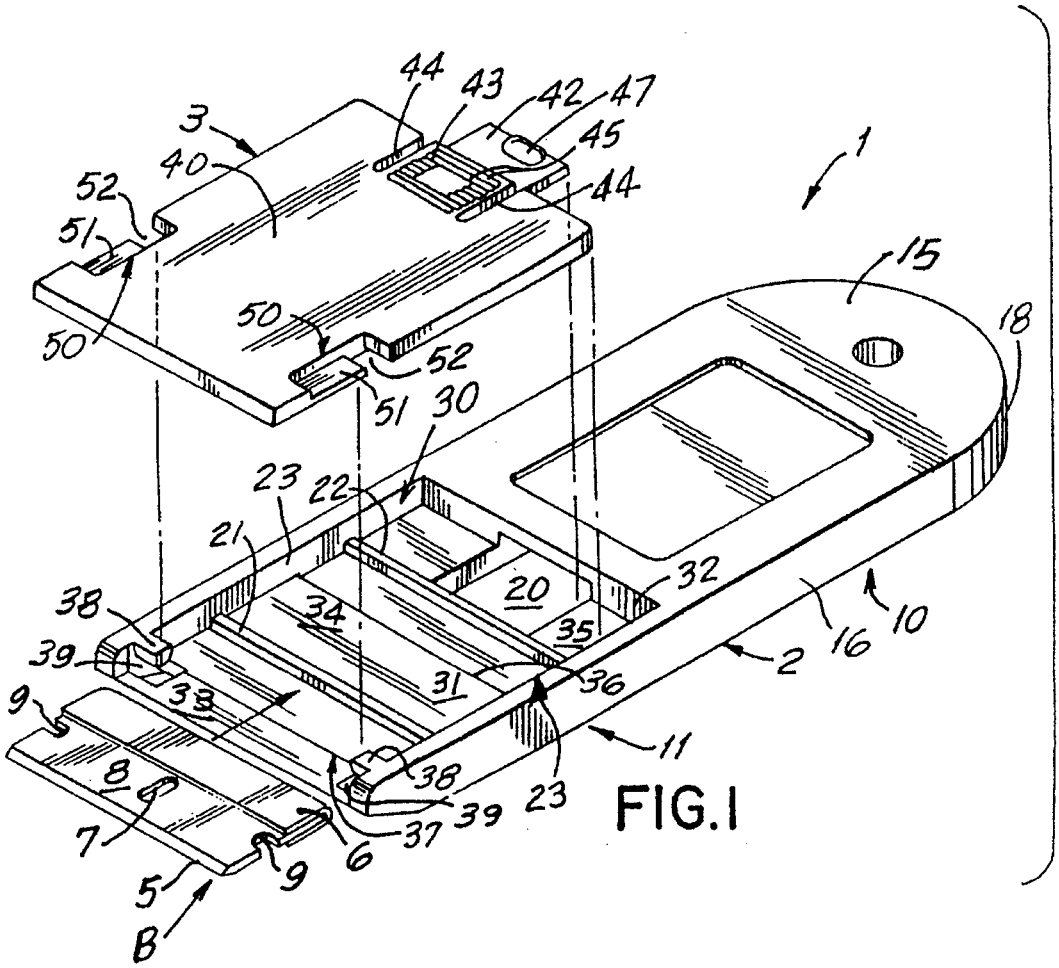
FIG. 1 is an exploded perspective view of the scraper of the present invention.
Figure 2:
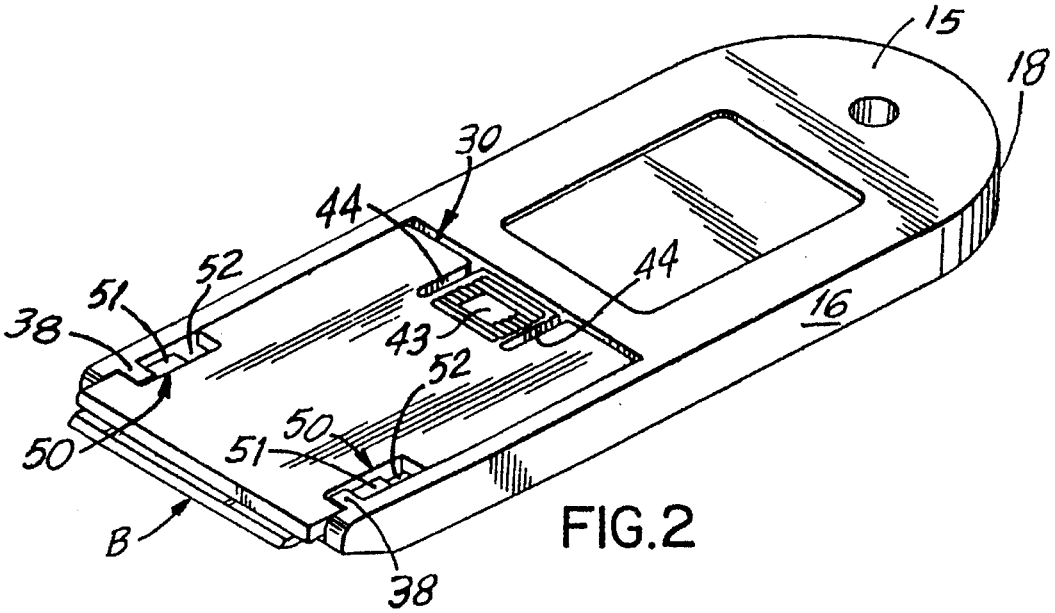
FIG. 2 is a perspective view of the scraper of the present invention in the active position.

Referring to the drawings, the scraper 1 of the present invention comprises a body portion 2 and a slidable cover portion 3 adapted to cooperate with the body portion 2 to cover or expose a single edge razor blade B.

The razor blade B to be used with the scraper 1 of the present invention is preferably a single edge razor blade B which has a metal body 8 with a cutting edge 5 at its front end and a back rib 6 on the other end to permit the blade to be grasped. The blade B may have an elongated opening 7 in the center of the body 8 and opposed notches 9 at the edges.

Both the cover 3 and the body portion 2 are preferably made of plastic and each may be manufactured in one piece by any well-known manufacturing operation. It will, of course, be understood that while the scraper of the present invention will be described as being preferably made of plastic, it is within the purview of the present invention to make the scraper 1 of a material other than plastic.

Figure 3:
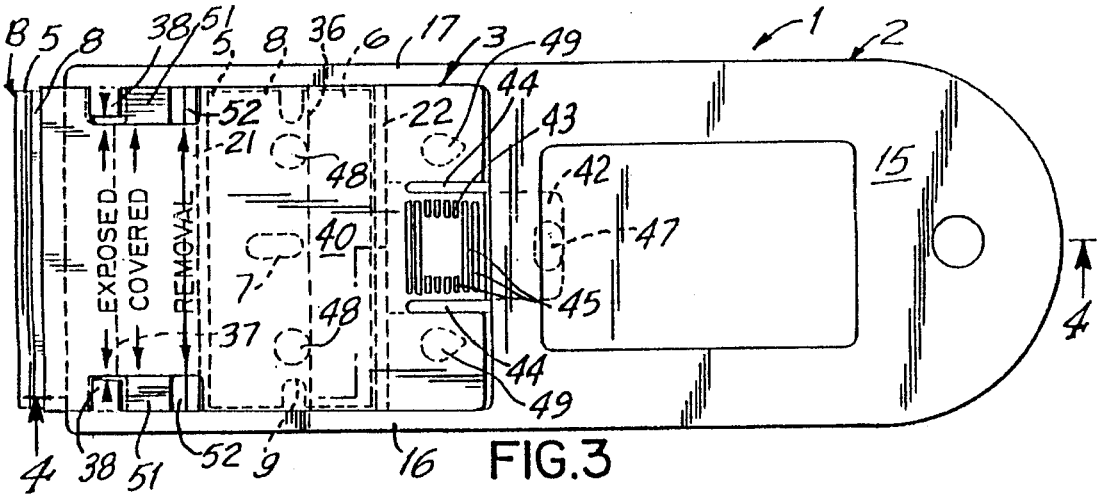
FIG. 3 is a top plan view of the scraper of the present invention.
Figure 4:
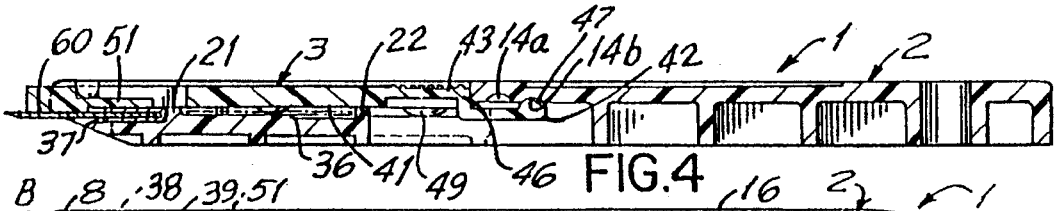
FIG. 4 is a sectional view taken along line 4—4 of FIG. 3.
Figure 5:
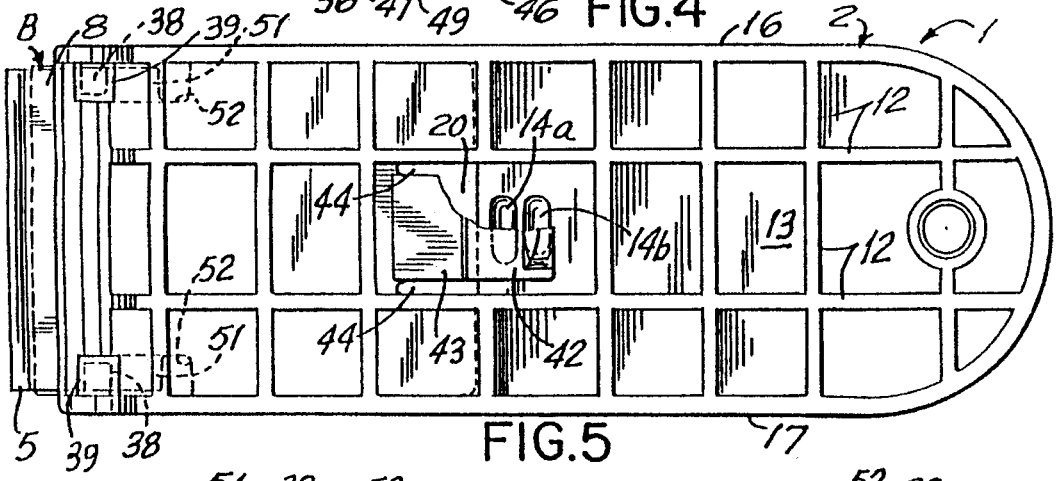
FIG. 5 is a bottom view of the scraper of the present invention.
Figure 6:
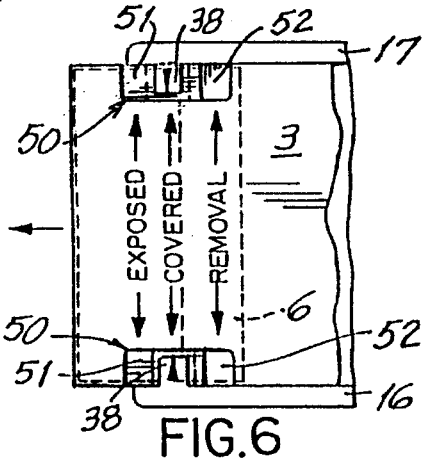
FIG. 6 is a fragmentary top view thereof showing the position of the parts when the blade edge is covered.
Figure 7:
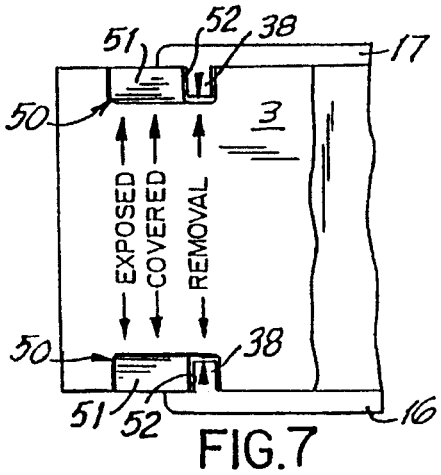
FIG. 7 is a top fragmentary view thereof showing the manner in which the cover may be removed.

The body portion 2 of the scraper 1 comprises a rear handle portion 10 and a front blade-receiving portion 11 which are shown in the drawing as being integral with each other. The body 2 is also provided with a pair of side walls 16 and 17 and a curved rear wall 18 joining the two side walls 16–17 together. The body 2 has a flat upper face 15 and a flat lower face 13 and is provided with a plurality of strengthening ribs 12 (FIGS. 3–4) extending from the lower face 13. The lower face 13 of the body is also provided with a plurality of indentations 14, to serve a purpose which will be further explained hereinafter. Preferably, the indentations 14*a* and 14*b* are elongated and oriented transversely of the body 2. However, it will be understood that the indentations 14*a* and 14*b* may assume a different shape and a different orientation and still be within the scope of the invention.

The front blade-receiving portion 11 of the body 2 comprises a cover-receiving cavity 30 which has a top surface 31 below the level of the top surface 15 of the rear handle portion 10 and is comprised of a rear wall 32, a pair of side walls 23, and an open front 33. The cavity 30 is separated by transverse walls 21 and 22 into forward, middle and rear areas 33, 34 and 35 respectively. The rear area 35 has a central opening 20 therein. The middle area 34 has a transverse ledge 36 and the forward area 33 is also provided with a transverse ledge 37. The forward area 33 receives a blade B which is held in place with its back 6 held in place behind the ledge 37. The middle area 34 is adapted to hold a spare blade B with its back 6 held in place behind ledge 36. The forward area 33 of the cavity 30 is provided with retainer lugs 38 extending inwardly from the top of the side walls 23 but spaced above the cavity floor 31 to leave a space 39 between the floor 31 and the lugs 38.

The cover portion 3 is slidably mounted in the blade-receiving cavity 30 of the front body portion 11. The cover portion 3 has a flat top face 40 and a flat bottom face 41 which terminates in a shelf 60 at its front end. A lock finger 42 extends rearwardly from the cover portion 3 in a plane below the plane of the top surface 40 and extends through the opening 20 in the handle portion 10 so as to underlie the front end of the handle portion 10. The lock finger 42 extends from a resilient thumbpiece 43 which is formed by cutting a pair of elongated notches 44 in the rear of the cover 3 to give the thumbpiece resiliency. The thumbpiece 43 may be provided with grip ribs 45 and is connected to the lock finger 42 by a depending strap 46 which allows the lock finger to be below the level of the top face 40 of the cover 3 and to underlie the rear handle portion 10.

The upperside of the lock finger 42 is provided with an elongated transverse rib 47 adapted to be inserted in and cooperate with the two indentations 14*a* and 14*b* in the lower face 13 of the handle portion 10 in order to lock the cover 3 in the proper position. The lower surface 41 of the cover 3 has a plurality of spaced protrusions (not shown) which are adapted to apply pressure to a blade B in the blade-receiving cavity.

The side edges of the cover 3 each have a pair of elongated notches 50 each of which comprise a lock tab 51 extending therefrom and located at a level below the top surface 40 of the cover 3. The lock tabs 51 terminate short of rear of the notches 50 in the cover 3 to form openings 52. The lock tabs 51 are adapted to be inserted and are locked in place below the lugs 38 extending from the inner walls 23 of the blade-receiving cavity 30 in order to hold the front of the cover 3 in place on the handle. The cover 3 is slidably held in place at the front by the lock tabs 51 beneath lugs 38 and the rear finger 42 mounted within one of the indentations 14*a* or 14*b*.

When the scraper 1 is to be assembled together, a blade B is placed in the blade-receiving cavity 30 with its body 8 mounted beneath the lock lugs 38 in the space 39 therebeneath and the back 6 held in place between transverse wall 21 and transverse ledge 37. The cover 3 is then slipped over the front of the body portion 2 so that the rear extending finger 42 is moved into the opening 20 and is mounted below the forward part of the handle portion 10 with its protrusion 47 mounted in one or the other of the indentations 14*a* and 14*b*. The front part of the cover 3 is held in place by the lock tabs 51 beneath the lugs 38. With this structure, the blade B may be exposed by moving the cover 3 back so that the rear protrusion 47 enters into the rear indentation 14*b*. The blade B may then be covered by moving the cover 3 forward so that the rear protrusion 47 enters into the front indentation 14*a*. The shelf 60 will cover the entire blade so that it is not exposed.

When it is desired to remove the cover in order to change the blade, the rear finger 42 is moved downwardly so that the protrusion 47 becomes disengaged from the indentations 14*a* or 14*b* and the cover is moved forwardly so that the openings 52 are now in line with the lugs 38 in the handle. In this position, the cover 3 can be removed by moving the openings 52 past the lugs 38 and new blades placed in the scraper. After this is accomplished, the cover 3 can be reassembled by placing it so that the openings 52 overlie the lugs 38 and pressing the cover 3 down to move the lugs 38 through the openings 52 and moving the cover 3 rearwardly so that the lock tabs 51 are in the space 39 beneath the lugs 38 in order to lock the cover 3 in place.

It will thus be seen that the present invention provides an improved scraper which has improved means for exposing or covering the blade of a single edge safety razor blade which may be inexpensively manufactured, in which the blade may be easily removed and replaced and which is lightweight and easy to handle.

Other and further objects of the invention will be obvious upon an understanding of the illustrative embodiment about to be described, or will be indicated in the appended claims and various advantages not referred to herein will occur to one skilled in the art upon employment of the invention in practice.

The embodiments of the invention in which an exclusive property or privilege is claimed are defined as follows:

1. A scraper comprising a body portion having a front edge and a cover portion mounted on and slidable relative to said body portion, said cover portion having a blunt non-cutting forward edge, a blade receiving cavity in said body portion for receiving a blade with its cutting edge extending beyond the front edge of the body portion, said cover portion overlying said cavity in said body portion, said blade being interposed between said body portion and said cover portion, said cover portion being slidable relative to the body portion from a retracted position exposing the blade cutting edge to an extended position with the blunt non-cutting forward edge overlying and covering the blade cutting edge, first holding means for holding the cover portion in its retracted position, second holding means adapted to hold the cover portion in its extended position, said first holding means comprising locking means on the cover portion and first locking means on the body portion cooperating with each other to hold the cover portion in said retracted position, said second holding means comprising said locking means on said cover portion and second locking means on the body portion cooperating with each other to hold the cover portion in its extended position, said locking means on the cover portion comprises a protrusion, said first and second locking means on the body portion comprise first and second indentations, respectively, the first indentation being spaced from the second indentation, maintaining means for maintaining the cover portion over said body portion cavity, said maintaining means comprising lock lug means and lock tab means cooperating with each other, the blade receiving cavity in the body portion has a cavity floor, side walls and a rear wall having an opening therein, a lock finger is provided on said cover portion said lock finger is a resilient finger, said lock finger having said protrusion, said lock finger extends rearwardly from the cover portion, said lock finger is attached to a thumbpiece formed by a pair of slots cut in the cover portion, said lock finger has at least a portion extending through said opening in the rear wall of said cavity to a position below the body portion.

2. A scraper as set forth in claim 1 wherein said indentations are provided in said body portion.

3. A scraper as set forth in claim 2 wherein said indentations are longitudinally spaced from each other along said body portion and wherein said protrusion is insertable in one of the indentations depending on whether the cover is in its extended or retracted position.

4. A scraper as set forth in claim 3, wherein said lock tab means are on the cover portion and said lock lug means are on the body portion, said lock lug means are spaced above the cavity floor of the cavity in the body portion with said lock tab means mounted for slidable movement below said lock lug means, the thickness of said lock tab means is less than the thickness of the cover portion.

5. A scraper as set forth in claim 4 wherein the said lock tab means are shorter than the cover portion.

6. A scraper as set forth in claim 5 wherein said lock tab means are formed along sides of the cover portion.

7. A scraper as set forth in claim 6 wherein openings are formed in the cover portion adjacent the lock tab means.

8. A scraper as set forth in claim 7 wherein the lock lug means are formed adjacent the front edge of the body portion.

9. A scraper as set forth in claim 8 wherein said cover portion is movable to a removal position where the lock tab means are moved to a position forwardly of the lock lug means so that the openings are aligned with the lock lug means to permit the cover to be removed by moving the openings past the lock lug means.

* * * * *